United States Patent [19]

Caffyn et al.

[11] 4,424,755

[45] Jan. 10, 1984

[54] INCINERATION SYSTEM HAVING CYCLONIC OXIDATION CHAMBER

[75] Inventors: Allan E. Caffyn, South Windsor, Conn.; James L. Lobik, Springfield, Mass.

[73] Assignee: Industronics, Inc., South Windsor, Conn.

[21] Appl. No.: 429,052

[22] Filed: Sep. 30, 1982

[51] Int. Cl.[3] ..... F23G 5/06

[52] U.S. Cl. ..... 110/246; 110/210; 110/211; 110/213

[58] Field of Search ..... 110/235, 203, 210, 211, 110/213, 214, 216, 246, 264; 431/5

[56] References Cited

U.S. PATENT DOCUMENTS

| | | | |
|---|---|---|---|
| 2,929,342 | 3/1960 | Young | 110/211 |
| 3,073,684 | 1/1963 | Williams, Sr. | 431/5 X |
| 3,656,441 | 4/1972 | Grey et al. | 110/216 X |
| 3,792,670 | 2/1974 | Dimozzi | 110/213 |
| 3,823,677 | 7/1974 | Polsak | 110/246 |
| 4,351,249 | 9/1982 | Inovius | 110/210 |

FOREIGN PATENT DOCUMENTS

| | | | |
|---|---|---|---|
| 3043286 | 10/1981 | Fed. Rep. of Germany | 110/213 |

*Primary Examiner*—Edward G. Favors
*Attorney, Agent, or Firm*—McCormick, Paulding & Huber

[57] ABSTRACT

An incineration system includes a rotary drum incinerator unit having a primary oxidation chamber and a secondary oxidation chamber for receiving gases of combustion from said primary chamber. The secondary chamber has a plurality of coaxially arranged walls which define a torturous reversing spiral flow path for gases of combustion passing through said secondary chamber whereby to effect substantial retention time and cyclonic separation of particulate matter from the gases.

14 Claims, 5 Drawing Figures

10
12
2
2
16
29
28
36
14
35
33
40
40
30
18
24
34
32
26

INCINERATION SYSTEM HAVING CYCLONIC OXIDATION CHAMBER

BACKGROUND OF THE INVENTION

This invention relates in general to incineration systems of the heat recovery type and deals more particularly with improvements in incineration systems of the type which include a primary oxidation chamber and a secondary oxidation chamber for receiving gaseous products of combustion from the primary chamber.

The present invention is primarily concerned with improvements in systems for burning waste materials including solids, semi-solids, liquids and sludges, individually or in combination. In such systems, retention time, that is the time during which gases of combustion are retained within the system, is a major factor in the determination of system efficiency. Further, it has been generally essential that such refuse burning systems include efficient auxiliary emission control equipment, as, for example, scrubbers, baghouses, and the like, which add substantially to the cost of a system.

It is the general aim of the present invention to provide an improved incineration system of the aforedescribed general type which provides for efficient separation of particulate matter and substantial retention time to attain a high degree of system efficiency and, whereby requirements for auxiliary emission control equipment are substantially reduced, if not wholly eliminated.

SUMMARY OF THE INVENTION

In accordance with the present invention, an improved incineration system has wall means defining a primary oxidation chamber and an axially elongated secondary oxidation chamber which communicates with the primary oxidation chamber for receiving gaseous products of combustion from the primary oxidation chamber. The wall means includes a first wall which defines an axially extending first portion of the secondary oxidation chamber. The first portion has an inlet opening at one end and an outlet opening at its opposite end. The wall means further includes a second wall which defines an axially extending second portion of the secondary chamber. The second portion has an annular part which surrounds at least part of the first portion. The second portion communicates with the inlet opening and is also in communication with the primary oxidation chamber. The first and second portions cooperate to define a gas flow path through and from the secondary oxidation chamber.

DETAILED DESCRIPTION OF PREFERRED EMBODIMENT

Figure 1:
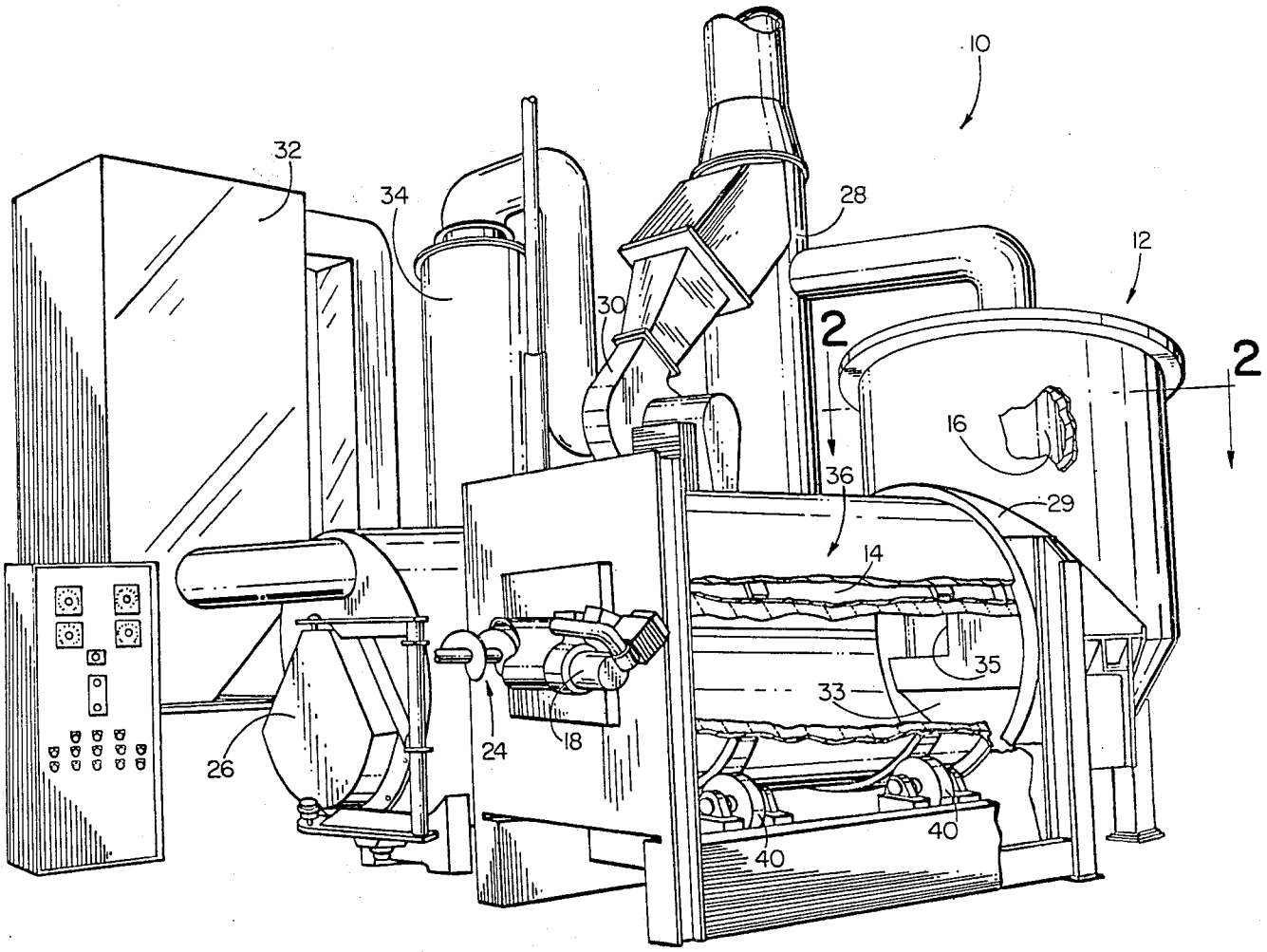
FIG. 1 is a perspective view of an incineration system embodying the present invention.

Referring now to the drawings, and first considering FIG. 1, an incineration system embodying the present invention is indicated generally by the reference numeral 10. The illustrated system 10 generally comprises an incinerator, designated generally by the numeral 12, which includes a rotary primary oxidation chamber 14 and a secondary stationary oxidation chamber 16, which receives gaseous products of combustion from the primary oxidation chamber. An ignition burner 18 initiates the incineration process and, depending on the nature of the waste material being burned, may supply additional heat to maintain required temperatures within the primary oxidation chamber 14, where the waste material being burned has such a low BTU value per pound that the oxidizing process will not be self-sustaining. One or more additional burners, such as the burner 20 shown in FIGS. 2 and 3, may be provided, as necessary, to assure maintenance of a predetermined temperature within the secondary oxidation chamber 16. An ash receiver 22, located below the secondary oxidation chamber 16, and best shown in FIG. 3, receives ash and other unburned materials from both the primary and secondary oxidation chambers.

A suitable feeding apparatus is provided for handling the waste material to be processed in the system 10. The illustrated system is particularly adapted to burn solid and semi-solid waste and/or sludge and has an auger/shredder feeding apparatus indicated generally at 24 in FIG. 1. This feeding apparatus is particularly adapted to shred and compact bulky solid waste material as it is fed into the incinerator 12.

In the illustrated system 10, shown in FIG. 1, hot gases from the secondary oxidation chamber 16 pass into a heat exchanger, such as the illustrated waste heat boiler 26, through a refractory lined stack 28 which has a build-in bypass to allow hot gases to pass directly up the stack under emergency conditions and while the feeding apparatus 24 is being shutdown. A strategically located exhaust fan 30 induces draft to create negative pressure within the system while returning to the atmosphere environmentally safe gases received from auxiliary emission control equipment which include a baghouse 32 and a packed tower scrubber 34, which also comprises part of the illustrated system 10. The system 10 also has controls and associated instrumentation for monitoring and controlling operation of the incinerator 12 and its associated pollution control apparatus to allow continuous operation of the system with minimal supervision.

Figure 3:
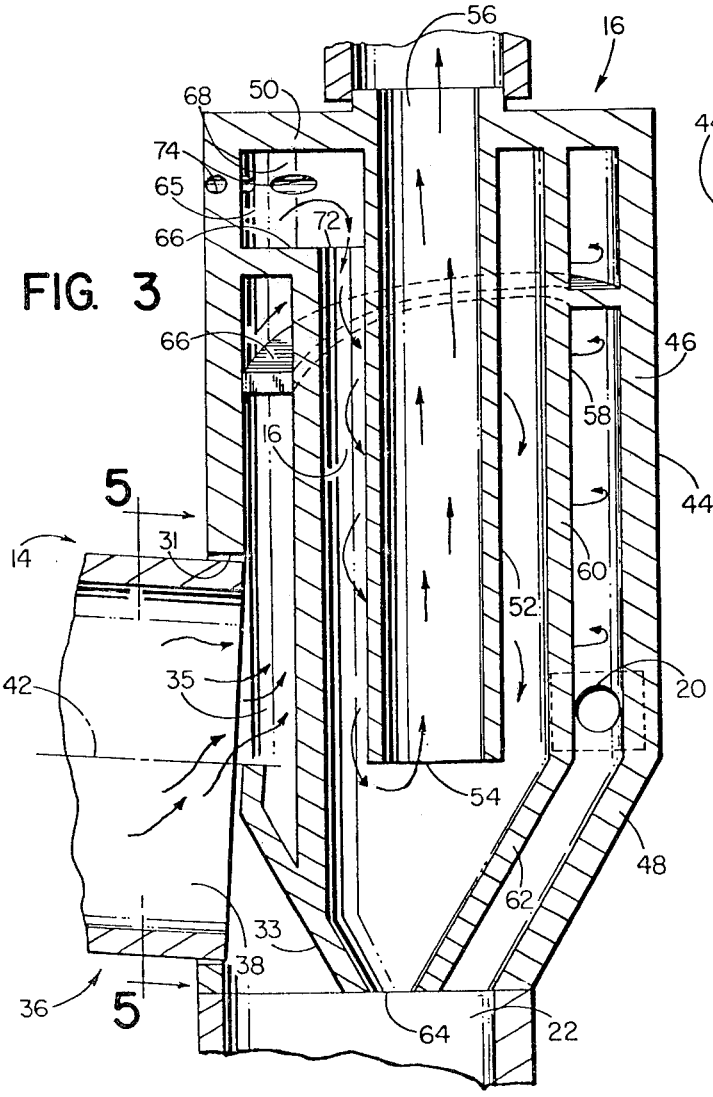
FIG. 3 is a fragmentary sectional view taken generally along the line 3—3 of FIG. 2.
Figure 5:
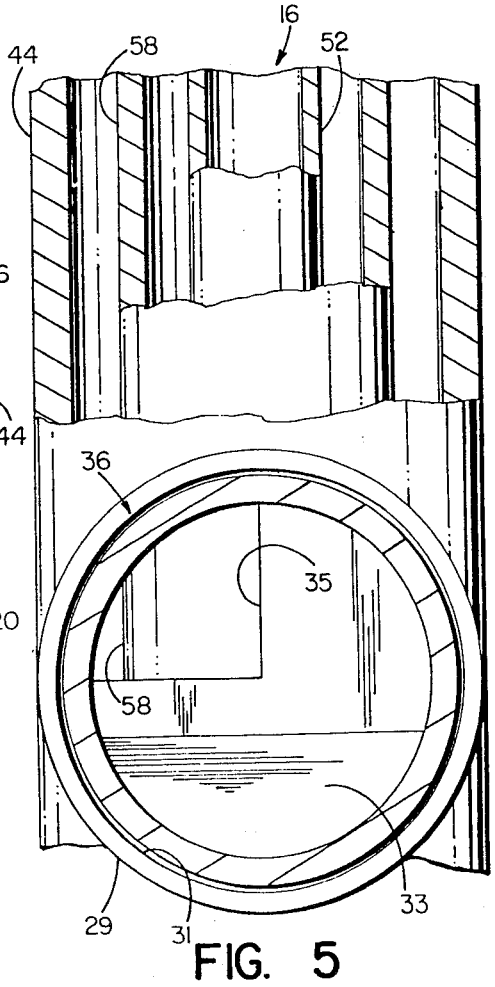
FIG. 5 is a sectional view taken along the line 5—5 of FIG. 3.

Considering now the incinerator 12 in further detail, the primary oxidation chamber 14 comprises a cylindrical drum, indicated generally 36, which is closed at its front end and which has a discharge opening 38 at its rear end, best shown in FIG. 3. Preferably, the drum 36 has an outer wall or shell formed from sheet metal and an inner wall formed by a lining of refractory material. A plurality of rollers 40, 40 journalled on a supporting frame structure and engaged with annular bands which surround the outer periphery of the drum shell support, support the drum 38 for rotation about its axis, as shown in FIG. 1. The drum 36 is preferably supported with its axis of rotation, indicated at 42, downwardly inclined in the direction of its discharge end 38. The rollers 40, 40 at opposite sides of the drum are adjustable generally toward and away from each other to vary the angle of inclination of the drum axis 42. A reversible, variable speed drive motor (not shown) rotates the drum 36 about its axis 42. Suitable air inlets (not shown) are or may be provided to admit makeup air into the primary oxidation chamber 14 defined by the drum 38.

Preferably, and as shown, the secondary oxidation chamber 16 comprises a generally cylindrical axially vertically disposed chamber defined by an outer wall 44 and a plurality of inner walls which cooperate with the outer wall and with each other to define a torturous cyclonic gas flow path from the primary combustion chamber 14 to the stack 28, as will be hereinafter more fully described.

The secondary oxidation chamber 16 also includes a transitional portion 29 which is joined to the outer wall 44 and defines a cylindrical opening 31 which receives the discharge end of the drum 36. A fixed baffle wall 33 within the secondary oxidation chamber extends generally across the opening 31 and has an inlet port 35 formed therein which communicates with the interior of the secondary oxidation chamber.

Further considering the secondary combustion chamber 16, the outer wall 44 preferably comprises a shell which has a liner formed from refractory material. The outer wall 44 has a generally cylindrical upper portion, indicated at 46, and a frustoconical lower portion 48 which is open at its lower end and communicates with the ash receiver 20, substantially as shown in FIG. 3. A radially disposed top wall 50 provides a closure for the upper end of the secondary oxidation chamber 16.

The stationary inner walls of the secondary chamber 16 are preferably coaxially arranged and include an axially extending first inner wall 52 which projects downwardly from the top wall 50 and terminates proximate the junction between the upper portion 46 and the upper end of the frustoconical lower portion 48. The wall 52 has an inlet opening 54 at its lower end and defines a generally cylindrical axially extending portion of the gas flow path which terminates at an exhaust port 56 which opens through the top wall 50. A generally cylindrical second inner wall 58 has an annular upper portion 60 which coaxially surrounds the first inner wall 52. The wall 58 has a lower portion, indicated by the numeral 62, which is generally frustoconical and converges to a discharge opening 64 which communicates with the ash receiver 22. In the illustrated embodiment the outer wall 44 comprises a third annual wall which surrounds at least a portion of the second annular wall 58 and cooperates with it to define a further portion of the gas flow path from the primary combustion chamber 14 to the exhaust port 56.

Figure 2:
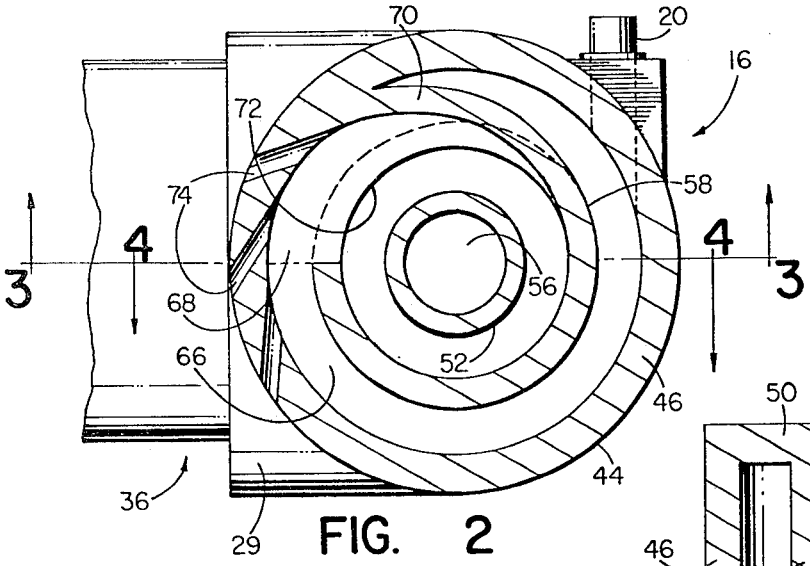
FIG. 2 is a somewhat schematic sectional view through the secondary oxidation chamber taken generally along the line 2—2 of FIG. 1.
Figure 4:
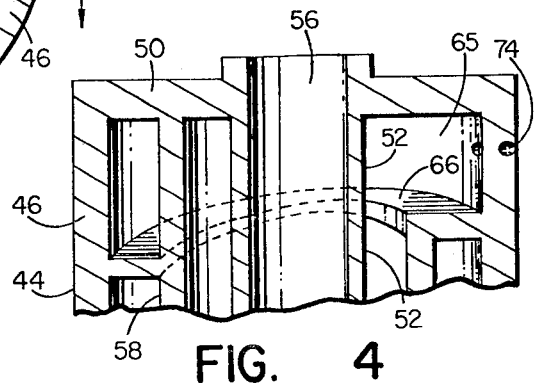
FIG. 4 is a fragmentary sectional view taken along the line 4—4 of FIG. 2.

In the illustrated embodiment 10, a spiral passageway at the upper end of the secondary combustion chamber, indicated by the numeral 65 and shown in FIGS. 2–4, defines a portion of the gas flow path through the secondary oxidation chamber and provides communication between a portion of the flow path defined by the outer wall 44 and the inner wall 58 and another portion of the flow path defined by the inner wall 58 and the inner wall 52. The passageway 65 is defined, in part, by a horizontally disposed spiral wall 66 which extends generally between the inner wall 58 and the outer wall 44. The upper part of this spiral wall terminates at an inlet opening 68 which provides communication between the portion of the passageway defined by the outer wall 44 and the inner wall 58 and another portion of the passageway defined by the inner wall 58 and the inner wall 52. More specifically, the inlet opening 68 is defined by the upper surface of the wall 66, a portion of the lower surface of the top wall 50, and the inner surface of an arcuate transitional wall 70 which extends between the upper part of the outer wall 44 and the inner wall 58, as best shown in FIG. 2. The upper portion of the spiral wall 66 terminates at an edge 72 which forms a junction with an upper edge of the inner wall 58, as best shown in FIG. 2. One or more air inlet openings, such as indicated at 74, may be provided in the outer wall 44 near the upper end of the secondary oxidation chamber 16. Preferably, and as best shown in FIG. 2, each air inlet opening 74 is tangentially arranged relative to the inner surface of the wall 44.

Combustible waste materials which may comprise solids, semi-solids, liquids, and sludges, individually or in combination, are fed into the primary oxidation chamber by the feeding apparatus 24. The burning waste material is advanced by the rotating drum 36 toward its discharge end. Ash and other unburned materials leave the drum through the lower portion of the discharge opening 38 and drops directly into the ash receiver 22.

The volatile products of combustion leave the primary combustion chamber 14 through the upper portion of the discharge opening 38 and flow into the secondary oxidation chamber 16 through the inlet port 35 to the portion of the chamber between the walls 44 and 58. The draft induced within the stack 28 by the exhaust fan 30 creates a negative pressure within the secondary oxidation chamber and, due to the configuration of the chamber, cause the volatile gases to flow in a cyclonic path through the chamber from the inlet opening 35 toward and through the exhaust port 56, as generally indicated by the directional arrows in FIG. 3. The gases initially flow in an upwardly spiraling path, enter the spiral passageway 65, and flow upwardly within the latter passageway to and through the inlet opening 68. The arcuate transitional wall 70 directs the flow of gas into the space between the inner walls 58 and 52 whereupon the hot gases spiral downwardly toward the inlet opening 54 at the lower end of the first inner wall 52. Gases leaving the secondary combustion chamber flow upwardly through the inlet opening 54 to and through the exhaust port 56 and through a duct to the stack 28. The lengthy, torturous flow path through the secondary oxidation chamber assures substantial retention time.

Ash and other particulate matter entrained in the gases which flows through the secondary combustion chamber 16 undergo cyclonic separation. Further separation occurs when the velocity of the gases decrease and the regions of the chamber where the direction of gas flow changes, that is at the upper and lower portions of the chamber. Particulate fallout also occurs when the entrained particulate matter impinges upon the various walls of the chamber. Fallout material travels downwardly through the secondary combustion chamber and into the ash receiver 22 therebelow.

In the illustrated system 10, hot gases from the secondary oxidation chamber flow from the stack 28 into the heat recovery boiler 26 which, as shown, comprises a three-pass horizontal, fire tube package boiler designed to operate at pressures up to 150 PSI, however, heat exchangers of other types may be used to recover heat from gases generated by the incineration system 10. Gases are ducted from the boiler 26 into a baghouse 32. Particules entrained in the gas stream enter the lower section of the baghouse and pass through filter tubes (not shown). Particulate materials are retained on the outer surfaces of these tubes. Clean gases leave the baghouse through an associated exhaust duct and flow into the base of the scrubber 34 where noxious gases such as chlorine, hydrogen chloride, and hydrogen sulfide, for example, are removed from the gas stream by a gas absorption process, well known in the art. After the moist gases have passed through a demister section of the scrubber, where final traces of moisture are removed, the dry gases leave the scrubber and are ducted to the exhaust fan 30 and exhausted to atmosphere.

The, incineration system hereinbefore described, includes substantial emission control equipment, however, it should be understood that such auxiliary equipment should not be required for most waste materials processed. It is expected that the illustrated incineration unit, without such auxiliary emission control equipment, will meet current environmental requirements of 0.08 grains per dry standard cubic foot of gas correlated to 12% $CO_2$ when processing waste materials of classification types 0, 1, 2, 3 and 4.

We claim:

1. In an incineration system having means defining a primary oxidation chamber for receiving material to be incinerated, and means defining an axially elongated secondary oxidation chamber for receiving gaseous products of combustion from said primary oxidation chamber and having an inlet port in communication with said primary oxidation chamber, an exhaust port, and a plurality of walls cooperating to define a torturous flow path for gaseous products of combustion flowing from said primary oxidation chamber into and through said secondary oxidation chamber to said exhaust port, the improvement wherein said secondary oxidation chamber comprises a cyclonic chamber and said walls comprise a plurality of generally annular walls including a first annular wall defining said exhaust port and extending for some distance in an axial direction into said secondary chamber to define one portion of said gas flow path and terminating at a first inlet opening within said secondary oxidation chamber axially spaced from said exhaust port and a second annular wall surrounding at least a portion of said first annular wall and cooperating with said first annular wall to define another portion of said gas flow path in communication with said first inlet opening, said second annular wall having an inlet opening therein spaced from said first inlet opening in the direction of said exhaust port and in communication with said inlet port and said other portion of said gas flow path.

2. In an incineration system as set forth in claim 1 wherein said annular walls include a third annular wall surrounding at least a portion of said second annular wall and cooperating with said second annular wall to define still another portion of said gas flow path.

3. In an incineration system as set forth in claim 2 the further improvement wherein said second annular wall terminates at said one end in a frustoconical portion which converges in the direction of said one end.

4. In an incineration system as set forth in claim 3 the further improvement wherein said third annular wall terminates at one end in a frustoconical portion which converges toward said one end.

5. In an incineration system as set forth in claim 2 the further improvement wherein said third annular wall comprises the outer wall of said secondary oxidation chamber.

6. In an incineration system as set forth in any one of claims 1 through 5 wherein said annular walls are coaxially arranged.

7. In an incineration system as set forth in claim 6 wherein said annular walls comprise generally cylindrical walls.

8. In an incineration system as set forth in either claim 1 or claim 2 the further improvement wherein said second inlet opening is defined by a passageway between said annular walls forming a part of said gas flow path.

9. In an incineration system as set forth in claim 8 the further improvement wherein said passageway comprises a generally helical passageway.

10. In an incineration system as set forth in claim 9 the further improvement wherein said helical passageway circumscribes at least one full convolution about the axis of said secondary oxidation chamber.

11. In an incineration system as set forth in claim 10 the further improvement wherein said secondary chamber is axially vertically disposed and said helical passageway is partially defined by a generally horizontally disposed spiral wall extending between annular walls of said secondary oxidation chamber.

12. In an incineration system as set forth in claim 1 the further improvement wherein said primary oxidation chamber comprises a rotary drum having a discharge opening at one end thereof in communication with said inlet port and said secondary oxidation chamber has a stationary baffel wall extending generally across said discharge opening and having an opening therethrough at least partially defining said inlet port.

13. In an incineration system s set forth in claim 12 the further improvement wherein said inlet port is partially defined by the outer wall of said secondary oxidation chamber.

14. In an incineration system as set forth in claim 1 the further improvement wherein said annular walls comprise generally cylindrical walls and said secondary combustion chamber has at least an air intake port extending through the outer wall thereof in a direction generally tangent to the inner surface of said outer wall.

* * * * *